United States Patent [19]

Bias

[11] 4,034,471

[45] July 12, 1977

[54] PROCESS OF ISOLATING BONDING MATERIAL ON A TERMINAL PLATE

[75] Inventor: Eugene E. Bias, Shreveport, La.

[73] Assignee: Western Electric Company, Inc., New York, N.Y.

[21] Appl. No.: 682,884

[22] Filed: May 3, 1976

[51] Int. Cl.[2] ..... B21D 53/36

[52] U.S. Cl. ..... 29/629; 72/47; 113/119

[58] Field of Search ..... 72/47; 29/527.4, DIG. 4, 29/629; 113/119, 120 A, 15 A; 228/215, 254, 154; 339/275 R, 275 A, 275 C, 275 T

[56] References Cited

U.S. PATENT DOCUMENTS

| | | | |
|---|---|---|---|
| 1,931,311 | 10/1933 | Young | 285/49 |
| 2,159,325 | 5/1939 | Fabrice | 113/15 A |
| 3,065,442 | 11/1962 | Hubbell et al. | 339/95 |
| 3,075,487 | 1/1963 | Appleton | 113/120 R |
| 3,339,008 | 8/1967 | MacArthur et al. | 174/68.5 |
| 3,422,320 | 1/1969 | Woodling | 228/254 |
| 3,599,326 | 8/1971 | DiRenzo | 29/626 |
| 3,823,464 | 7/1974 | Chartet | 228/154 |

*Primary Examiner*—E. M. Combs
*Attorney, Agent, or Firm*—W. G. Dosse; R. P. Miller

[57] ABSTRACT

A circuit component having a solder connection and screw-clamp terminal connection is formed from brass, solder-coated coiled stock with a portion of the brass exposed to separate the solder connection from the area of the screw connection in order to block the molten solder from migrating into the screw connection. The screw connection is cold-formed with radially-oriented, inwardly-sloping projections or fins arranged around a central threaded opening to engage the tines of a terminal lug as it is screw-clamped in place. The radial projections or fins, by being cold-formed, are work-hardened and bite into the U-shaped tines of the terminal lug as the screw is tightened. This prevents the terminal lug from turning as the screw descends and clamps the terminal in place. The inward slope of the projections or fins cams the tines of the terminal lug towards the screw threads, thus preventing the tines from splaying outwardly.

11 Claims, 5 Drawing Figures

PROCESS OF ISOLATING BONDING MATERIAL ON A TERMINAL PLATE

FIELD OF THE INVENTION

The present invention relates to bonding on connectors and more particularly to a connector or terminal plate with biting projections for enhancing an electrical connection and for deforming the connector and thus excluding bonding material from the area of the projections.

BACKGROUND OF THE INVENTION

In almost all electrical and electronic equipment, screw connections are made to wires either directly or using terminal spade lugs that are clamped, soldered or welded to the ends of the wires. These terminal lugs customarily have U-shaped ends, the two tines of which straddle the threaded shank of the screw. In making such a screw connection using a U-shaped terminal lug, the screw is turned until the head of the screw squeezes the tines of the lug onto the body or surface of the connector.

Anyone who has connected the U-shaped terminal spade lugs of a TV antenna twin-lead to the antenna input connector of a TV set knows that these lugs have a strong tendency to rotate with the screw head as they are clamped in place. Also, the clamping and twisting of the screw head tends to splay the tines of the terminal lug, causing them to spread and thus straddle the screw head and fall out. This can be frustrating, time consuming, and expensive to correct, especially in a production facility.

Screw connections are known in which the terminal is shaped in a way somewhat to constrain the terminal lug or wire. One example of such a constraint is illustrated in U.S. Pat No. 3,065,442 granted on Nov. 20, 1962 to H. Hubbell et al. In addition, it is known to make slight projections from the surface of the connector in order to engage terminal lugs and thus to keep them from twisting with the screw head.

Very often, screw connections are located in very close proximity to solder connections. When the terminal is solder coated or well fluxed, the highly-mobile, molten solder has a tendency to flow readily across the terminal surface from the solder connection and into the region of the screw connection. If the solder connection is made prior to the screw connection, the excess solder in the region of the screw connection can provide a substantial solder dross layer between the surface of the connector and the terminal lug, thereby impairing good electrical contact at the screw connection. In addition, the resultant thick coating of solder can cover any projections at the screw terminal and prevent them from biting into the bottom of the terminal lug and can actually lubricate the bottom of the terminal lug to facilitate its rotation with the screw head.

If the solder operation follows the screw connection, the excess solder flowing into the region of the screw connection can also solder that screw connection and frustrate any desired removal of the screw connection.

SUMMARY OF THE INVENTION

The present invention is concerned with making a connection between a soldered first wire and a terminal-tipped second wire wherein the flow of solder from the first connection is prevented from reaching the second connection. More particularly, a terminal plate constructed of solder repellent material is provided with a solder coating that is interrupted during the fabrication of a connection seat for the second connection to provide a barrier to the flow of solder resulting from application of heat to establish the solder connection with the first wire.

BRIEF DESCRIPTION OF THE DRAWINGS

A more complete understanding of the present invention may be had by referring to the following detailed description when considered in conjunction with the accompanying drawings in which like reference numbers designate the same or similar parts throughout the several views wherein.

DETAILED DESCRIPTION

Figure 1:
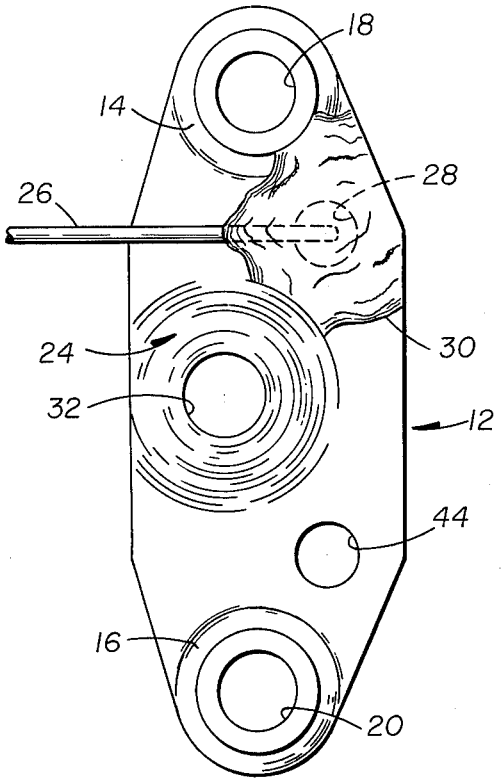
FIG. 1 PRIOR ART
FIG. 1 is an illustration of the prior art.

Referring now to the drawings and more particularly to FIG. 1, a prior art piecepart 12 is shown. Such pieceparts are customarily used in telephone handsets. This piecepart is an electrical termination made principally of brass. The part 12 is formed with two frustoconical projections 14 and 16. Each projections has central opening 18 and 20. When the part 12 is placed in the plastic telephone handset, two projections on the plastic surface extend through the openings 18 and 20. This is a force-fit such that the part 12 is held in place by the friction of of these plastic projections extending through the openings 18 and 20.

The prior art piecepart 12 is manufactured in a combined stamping-punching operation in which the part 12 is punched from a sheet of half-hard brass stock. Following the punching operation, the part 12 is prepared for soldering by plating first with copper, then with solder. The part 12 is then machined to cut through the plated layers on the surface of the brass and thus expose the underlying brass to form a contact surface 24. Any machining operation, such as that needed to produce the surface 24 in FIG. 1, is expensive.

In a subsequent manufacturing operation, a wire 26 is soldered to the part 12 at a hole 28. No flux is used in this soldering operation, because the part 12 is solder plated. However, as illustrated in FIG. 1, the solder 30 does not migrate into the area of the surface 24; because unfluxed brass is not wetted by the solder and can thus be said to repel it.

The central opening 32 in the surface 24 is roll-threaded to receive a common electrical connector screw.

IMPROVED PART

Figure 2:
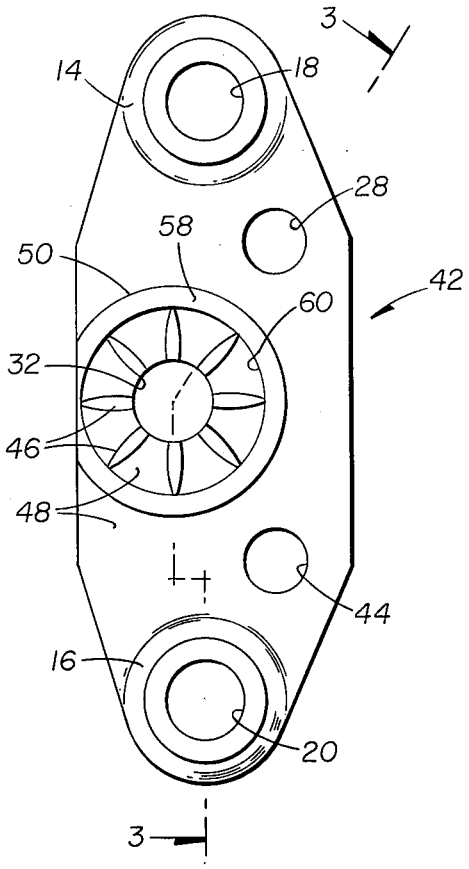
FIG. 2 is an illustration of a replacement part for the part illustrated in FIG. 1 but embodying the present invention.
Figure 3:
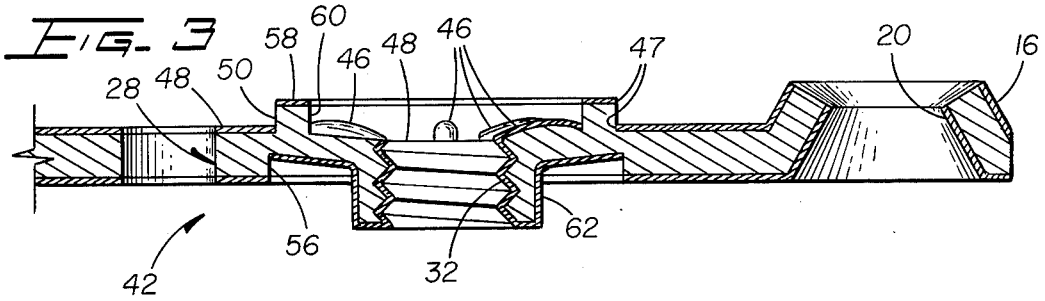
FIG. 3 is a cross-sectional view taken along line 3—3 of FIG. 2.

Referring now to FIGS. 2 and 3, the similarities between the piecepart 12 and an improved piecepart 42 are readily apparent. The projections 14 and 16 as well as the openings 18 and 20 are unchanged. The hole 28 and a companion hole 44 are also unchanged. The roll-threaded opening 32 of the improved part 42 is identical with the roll-threaded opening 32 of the old part 12.

However, the improved part 42 is made from 0.032 inch thick dead soft brass stock with a typical composition of 68.5 to 71.5% copper, 0.07% maximum lead, and the remainder zinc. The dead soft brass is chosen to allow it to work harden without excessive embrittlement. The brass stock has a 0.0001 inch thick copper plated "strike" for good adhesion followed by a 0.0001 inch minimum plating of solder having a typical composition of 60% tin and 40% lead.

The improved contact surface around the threaded openings 32 is no longer a planar, machined surface. Instead, a plurality of fins 46 are cold-formed and extend in a radially outward direction from threaded opening 32. The fins also extend away from the surface of part 42.

Referring now to the cross-sectional view labeled FIG. 3, in order to keep solder from migrating from the region around the hole 28, the solder plating 47 on the upper surface 48 of the part 42 is extended upwardly as illustrated during the manufacturing operation in order to break the plated solder coating 47 and expose a brass barrier surface 50 in a ring around the threaded opening 32. Therefore, when a wire is inserted in the hole 28 and is soldered in place, the solder readily adheres to the solder-plated surface 48 but is stopped by the barrier surface 50.

When the part 42 is formed, and when the surface 50 is sheared, a shear surface 56 is also formed on the opposite or bottom side of the part 42. The surface 56 is preferably offset somewhat from the surface 50 so as to prevent alignment of stress concentration and subsequent fracturing.

If the molten solder should manage to bridge the surface 50 and reach the raised or displaced and still-solder-plated ring 58 surrounding fins 46 and the threaded opening 32, that molten solder must be prevented from reaching the fins 46. Therefore, a surface 60 on the inside of the ring 58 is also sheared to expose the brass base material. The surface 60 is sheared during the cold compression formation of the fins 46 and a projection 62 containing the threaded opening 32. The threads and the fins 46 are still solder plated, the solder acting as a lubricant during the cold forming operation; but the solder has been locally thinned by the deformation of the underlying brass.

When the fins 46 are formed, the portion of the surface 48 within the ring 58 is depressed or displaced somewhat.

Figure 4:
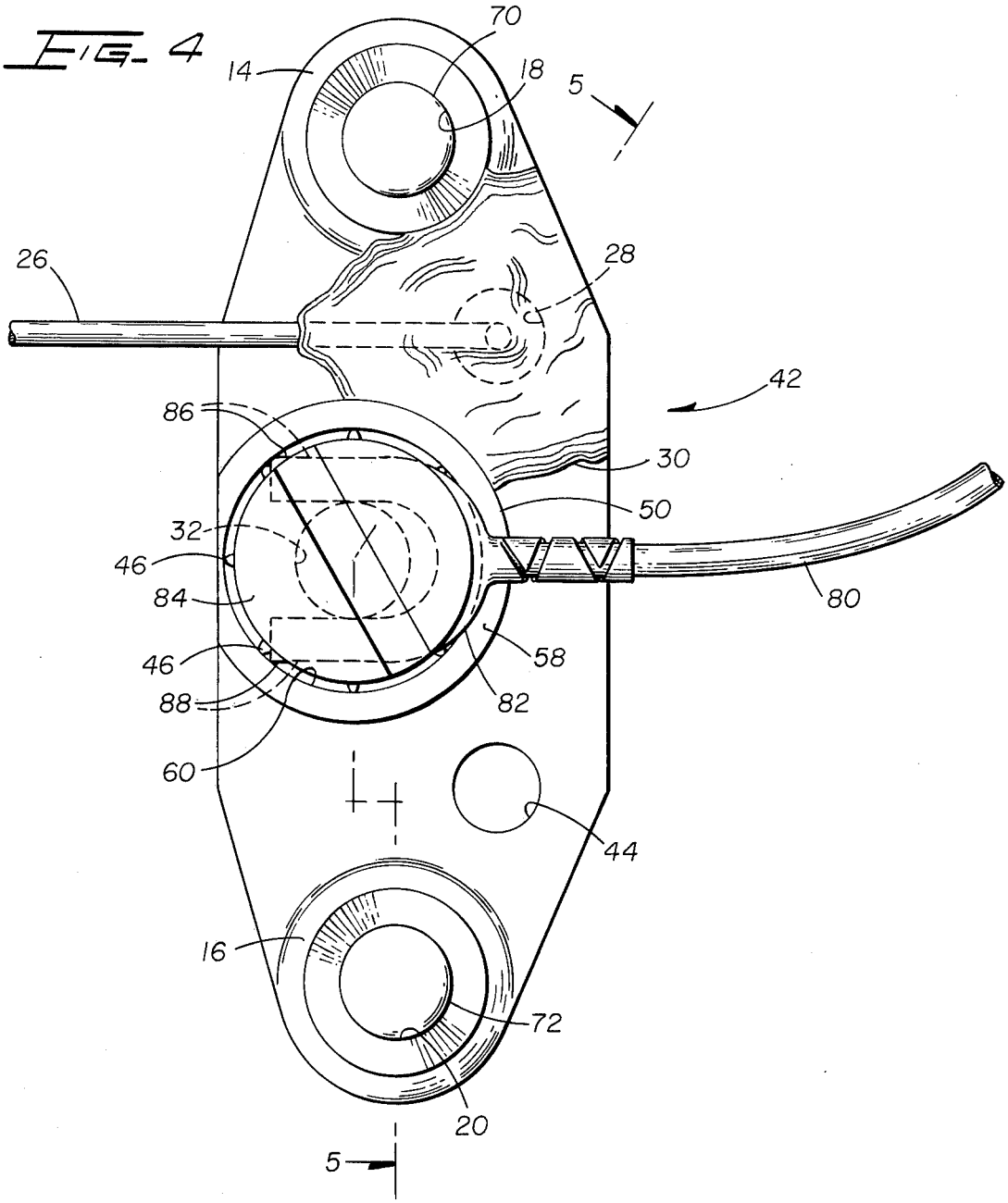
FIG. 4 is an enlarged view of the part illustrated in FIG. 2 but after a solder connection and screw connection have been made.
Figure 5:
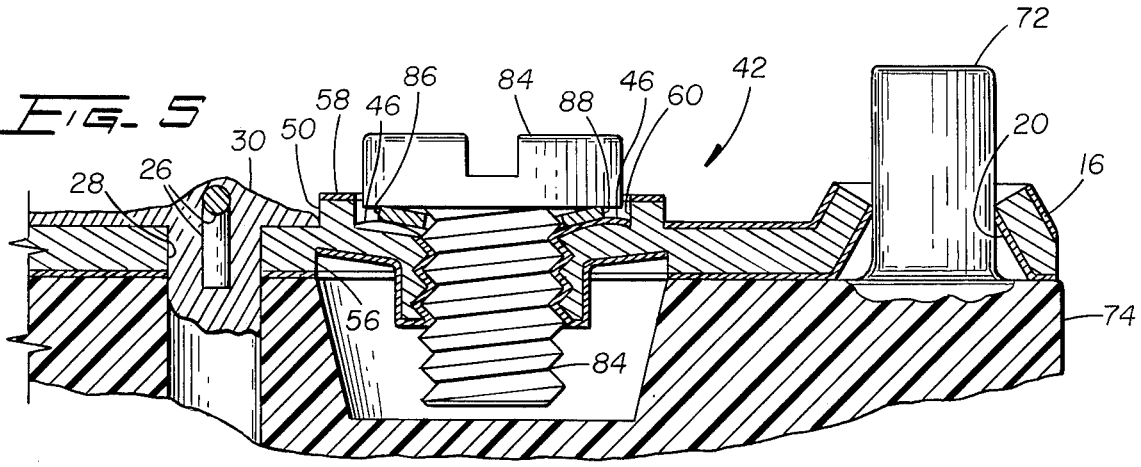
FIG. 5 is a cross-sectional view taken along line 5—5 of FIG. 4.

Referring now to FIGS. 4 and 5, the part 42 is shown in position with connections made to it. A plastic pin 70 an another plastic pin 72 project through the openings 18 and 20, respectively, to hold the part 42 to a body 74 plastic material inside of a telephone handset. The wire 26 is shown soldered into the hole 28 with a mass of solder 30 which has solidified into a position shown typically in FIGS. 4 and 5. The solder 30 has been stopped by the brass surface 50 that was exposed when the ring 58 was raised in the cold forming of the part 12. The solder 30 will not tin or wet the exposed, underlying brass of the surface 50 without the addition of flux. Since no flux is used to solder the wire 26 to the part 42, the solder 30 will only wet or tin those portions of the part 42 that are coated with a solder plate.

In order to make a removable electrical connection to part 42, a wire 80 is fastened to a U-shaped terminal lug or spade tip 82 which has a bifurcated connector portion that fits under a slot-headed screw 84 that fits into the threaded opening 32.

One tine 86 of the terminal lug 82 is positioned on one side of the screw 84 and another tine 88 of the terminal lug 82 is positioned on the other side of the screw 84. As the screw 84 is turned in a clockwise direction, as viewed in FIG. 4, the brass tines of the terminal lug 84 are pressed onto the top edges of the fins 46. The solder plating is only a minimum of approximately 0.0001 inch in thickness. However, after the fins 46 have been cold formed, the solder plating at the top edge of these fins is very much thinner. Therefore, as the bottom of the screw applies pressure to drive the tines 86 and 88 of the terminal lug 82 down onto the top edges of the fins 46, any solder coating is quickly swept away to expose the underlying brass. Since the brass base material has a tendency to work harden, the fins 46 are substantially harder than the soft brass of which a U-shaped electrical terminal lug 82 is made. Therefore, the hardened edges of the fins 46 bite into the lower surface of the tines 86 and 88 of the terminal lug 82. The biting engagement prevents the rotating screw 84 from twisting the terminal lug 82 and pulling on the wire 80.

As can be seen in FIG. 3 and 5 the fins 46 are sloped principally in a downwardly direction as they near the thread formed in the opening 32. As pressure is applied by the head of the screw 84 onto the tines 86 and 88 of the terminal lug 82, the slope of the fins 46 tends to cam the tines unwardly towards the threads of the screw 84. This camming action effectively prevents the tines from splaying radially outwardly as the screw 84 is tightened.

Although a particular embodiment of the invention is shown in the drawings and has been described in the fore-going specification, it is to be understood that other modifications of this invention, varied to fit particular operation conditions will be apparent to those skilled in the art; and the invention is not to be considered limited to the embodiment chosen for purposes of disclosure, and covers all changes and modifications which do not constitute departures from the true scope of the invention.

I claim:

1. A method of blocking the flow of a bonding material tending to flow to a path toward an area on an article; comprising:

making the article of a base material repellent to the bonding material;

covering the article with a coating material receptive to the bonding material; and deforming the repellent material and rupturing the recepting coating material to expose underlying repellent material and block the path of flow of the bonding material toward the area.

2. A method according to claim 1 wherein the exposing step is accomplished by raising repellent material above the receptive material to form a barrier in the path of flow of bonding material.

3. A method of making a component having a barrier to the migration of molten solder toward an area on the component, comprising:

coating with solder a material that is repellent to solder when unfluxed; and ductily forming the material to the shape of the component while simultaneously shearing the material at the location of the barrier to expose the repellent material and form a barrier of repellent material to the flow of material toward the area.

4. A method of making a component according to claim 3 wherein the shearing operation exposes the repellent material on a side of the component whereon soldering principally takes place and also exposes the repellent material on the peripheral edges of the component, so as to form a barrier to solder migrating to said opposite side of the component.

5. A method according to claim 4 wherein the exposed, repellent material on the side of the component where soldering principally takes place and the exposed repellent material on the opposite side of the component are displaced along the component so as to avoid minimizing the distance between the two areas of exposed repellent material thereby minimizing the likelihood of weakening the structure of the component.

6. A method according to claim 3 wherein the shearing operation also exposes repellent material at a second location to form a successive barrier to the flow of solder.

7. A method of protecting an area on article from a flow of bonding material wherein the article is constructed of a material that is repellent to the flow of bonding material and the article is surface coated with a layer of bonding material, which comprises:

cold forming the article to extend the coated surface to break the coated surface and expose a barrier surface about the area to prevent the flow of bonding material into the protected area.

8. A method as defined in claim 7 wherein the article is cold formed to break the surface to expose a second barrier surface between the first barrier surface and the protected area.

9. A method as defined in claim 7 wherein a hole is formed in the area and a plurality of radiating fins are cold formed to extend outwardly and upwardly from the hole toward the barrier surface.

10. In a method of making adjacent solder free and solder wire connections to a terminal plate coated with solder, wherein the terminal plate is made of material that is repellent to solder in the liquid state:

forming a wire receiving hole in the terminal plate;

forming a wire fastener receiving hole in the terminal plate, said fastener receiving hole being adjacent to the wire receiving hole so that liquid solder applied to the solder coating about the wire receiving hole would normally flow into the wire fastener receiving hole; and cold forming the article and shearing the solder coating to provide a ring extending about the wire fastener receiving hole which has a peripheral barrier surface free of coated solder to repel the normal flow of solder into the fastener receiving hole.

11. In a method as defined in claim 9, the further steps of:

cold forming a plurality of fins which radiate from the fastener receiving hole and extend outwardly and upwardly toward the barrier surface;

placing a U-shaped terminal lug on the article with tines, overlying the fins;

moving a shank of a headed fastener into the hole to move the headed fastener against the tines to cam inwardly the tines toward the shrank.

* * * * *